US011696059B2

(12) United States Patent
Han et al.

(10) Patent No.: US 11,696,059 B2
(45) Date of Patent: Jul. 4, 2023

(54) TWO-WAY RECEIVER HAVING FRONT BASS DUCT

(71) Applicant: EM-TECH Co., Ltd., Gyeongsangnam-do (KR)

(72) Inventors: Jun Hee Han, Gyeongsangnam-do (KR); Yong Ju Ji, Gyeongsangnam-do (KR)

(73) Assignee: EM-TECH Co., Ltd., Gyeongsangnam-do (KR)

( * ) Notice: Subject to any disclaimer, the term of this patent is extended or adjusted under 35 U.S.C. 154(b) by 0 days.

(21) Appl. No.: 17/563,655

(22) Filed: Dec. 28, 2021

(65) Prior Publication Data

US 2022/0210532 A1 Jun. 30, 2022

(30) Foreign Application Priority Data

Dec. 29, 2020 (KR) ..... 10-2020-0185455

(51) Int. Cl.

| | |
|---|---|
| ***H04R 1/04*** | (2006.01) |
| ***H04R 1/34*** | (2006.01) |
| ***H04R 1/02*** | (2006.01) |

(52) U.S. Cl.

CPC ..... *H04R 1/04* (2013.01); *H04R 1/025* (2013.01); *H04R 1/345* (2013.01)

(58) Field of Classification Search

CPC ..... H04R 1/04; H04R 1/025; H04R 1/345
USPC ..... 381/186
See application file for complete search history.

(56) References Cited

FOREIGN PATENT DOCUMENTS

| | | | |
|---|---|---|---|
| KR | 20020015633 | A | 2/2002 |
| KR | 101177322 | B1 | 8/2012 |
| KR | 101501898 | B1 | 3/2015 |
| KR | 101870261 | B1 | 6/2018 |
| KR | 102317353 | B1 | 10/2021 |

*Primary Examiner* — Sean H Nguyen
(74) *Attorney, Agent, or Firm* — Murphy, Bilak & Homiller, PLLC

(57) ABSTRACT

A two-way receiver includes a cylindrical frame, a yoke dividing an internal space of the frame and including a cylindrical portion, a first flange portion formed at an outer periphery of the cylindrical portion, a connection wall bent downward from the first flange portion, a second flange portion formed at an outer periphery of the connection wall, and a communication hole formed by deleting a portion of the connection wall and second flange portion. A first speaker unit is installed above the yoke, and a second speaker unit below the yoke. A protector coupled to a lower portion of the frame protects the second speaker. A bass duct formed on an outer periphery of the first speaker unit has a sound emission hole for emitting a sound of the first speaker unit emitted to the communication hole of the yoke to a position spaced apart from the communication hole.

6 Claims, 7 Drawing Sheets

TWO-WAY RECEIVER HAVING FRONT BASS DUCT

TECHNICAL FIELD

The present disclosure relates to a two-way receiver, and more particularly, to a yoke assembly for a two-way receiver and a two-way receiver having a front bass duct.

BACKGROUND

An active noise cancellation (ANC) function, a technology that cancels external noise using a reverse wavelength of noise, blocks ambient noise when a user wears an earphone so that the user may focus on sound quality more. Noise generally occupies a large proportion in a low frequency range. Therefore, as a condition for realizing the excellent ANC function, noise in the low frequency range is received by several microphones and an offset sound wave having a reverse phase is generated to cancel ambient noise.

In order to implement the above technology, a low frequency sound attenuation technology is essentially applied so that a basic low frequency sound pressure is lowered. To compensate for this, amplification of a low frequency range of a drive unit is an essential condition, and there is a limit to tuning with a general 1-way driver unit.

In order to improve this, individual frequency characteristics different from an overlap magnetic field may be output by adopting a two-way driver unit within the same size, instead of a 1-way driver.

FIG. 1 is a view illustrating a two-way speaker according to a related art. In the two-way speaker according to the related art, a cover 10 is coupled to an upper side of a frame 11 having an open top and a yoke 12 is coupled to the top of the frame 11 inside of the cover 10 to form a space portion in which a large speaker unit 30 may be installed between a yoke bottom plate 12-1 and a bottom surface of the frame 11.

In the yoke 12, a yoke cylinder 12-2 is integrally formed on an outer periphery of the yoke bottom plate 12-1 formed in a circular plate shape, a yoke flange 12-3 is integrally formed at an upper end of the yoke cylinder 12-2, and the yoke flange 12-3 protrudes slightly upward from an upper surface of the cover 10.

In an upper surface of the yoke flange 12-3 and the cover 10 coupled as described above, a sound emission hole 40 is formed so that a sound (consonant) generated from the large speaker unit 30, which will be described in detail below, is emitted (output) to the outside of a small speaker unit 20 described in detail below through the sound emission hole 40.

In the yoke 12, a first magnet 13 provided with a first magnetic plate 15 is installed (fixed) on an upper surface of the yoke bottom plate 12-1 to form a first air gap 26 between an outer periphery of the first magnet 13 and the yoke cylinder 12-2, and the smaller speaker unit 20 is installed in the yoke flange 12-3 above the first magnet 13.

The two-way speaker according to the related art provides the small speaker unit 20 and the large speaker unit 30, and a sound range is not described, but in general, the two-way speaker basically employs a woofer speaker and a tweeter speaker. The two speaker units have disadvantages in that heterogeneity, sensitivity deterioration, and sound quality deterioration (attenuation) occur due to frequency interference near a resonance point.

SUMMARY

An aspect of the present disclosure provides a two-way speaker having a bass duct, in which sound of middle and high frequency range, among sounds generated in a woofer speaker, is blocked and only sound of a low frequency range is discharged, thereby preventing frequency interference with a twitter speaker or lowering of sound pressure.

In an aspect, a two-way receiver includes: a cylindrical frame having a space for accommodating a component; a yoke dividing an internal space of the cylindrical frame up and down and including a cylindrical portion, a first flange portion formed at an outer periphery of the cylindrical portion, a connection wall bent downward from the first flange portion, a second flange portion formed at an outer periphery of the connection wall, and a communication hole formed by deleting a portion of the connection wall and a portion of the second flange portion; a first speaker unit installed above the yoke and including a first permanent magnet, a first plate, a first voice coil, and a first diaphragm; a second speaker unit installed below the yoke and including a second permanent magnet, a second plate, a second voice coil, and a second diaphragm; a protector coupled to a lower portion of the frame and protecting the second speaker; and a bass duct formed on an outer periphery of the first speaker unit and having a sound emission hole emitting a sound of the first speaker unit emitted to the communication hole of the yoke to a position spaced apart from the communication hole.

The two-way receiver may further include: an annular front cover having an outer periphery seated on the frame and an inner periphery seated on an outer periphery of the first diaphragm, wherein the bass duct may be defined by the frame, the second flange portion of the yoke, and the front cover.

The first diaphragm may be seated on the first flange portion, and the front cover may be attached to an upper surface of the first diaphragm.

The frame may cover an upper surface of the second flange portion and may be in contact with an outer periphery of the first flange portion, and a space for the bass duct may be secured by deleting a portion of the frame covering the upper surface of the second flange portion.

The sound emission hole may be formed at the front cover.

Sound of the first speaker may be emitted upward through a central perforation portion of the annular front cover, and sound of the second speaker may be emitted upward through the sound emission hole formed at the front cover through the communication hole of the yoke and the bass duct.

Since the two-way speaker provided in the present disclosure has the bass duct capable of blocking a sound of a middle and high frequency range, among sounds generated in a second speaker, frequency interference with a first speaker or lowering of a sound pressure may be prevented.

In addition, in the two-way speaker provided in the present disclosure, since the duct is formed on an outer periphery of the first speaker, space utilization may be increased.

DETAILED DESCRIPTION

Hereinafter, the present disclosure is described in detail with reference to the accompanying drawings.

Figure 1:
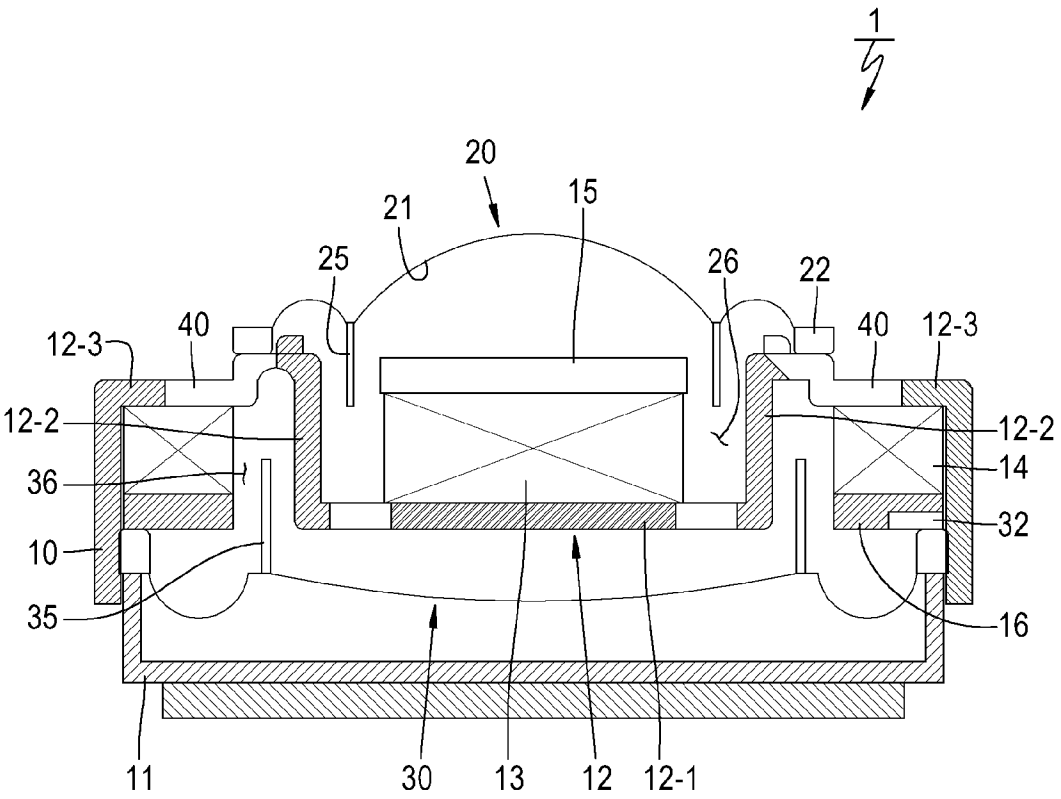
FIG. 1 is a view illustrating a two-way speaker according to the related art.
Figure 2:
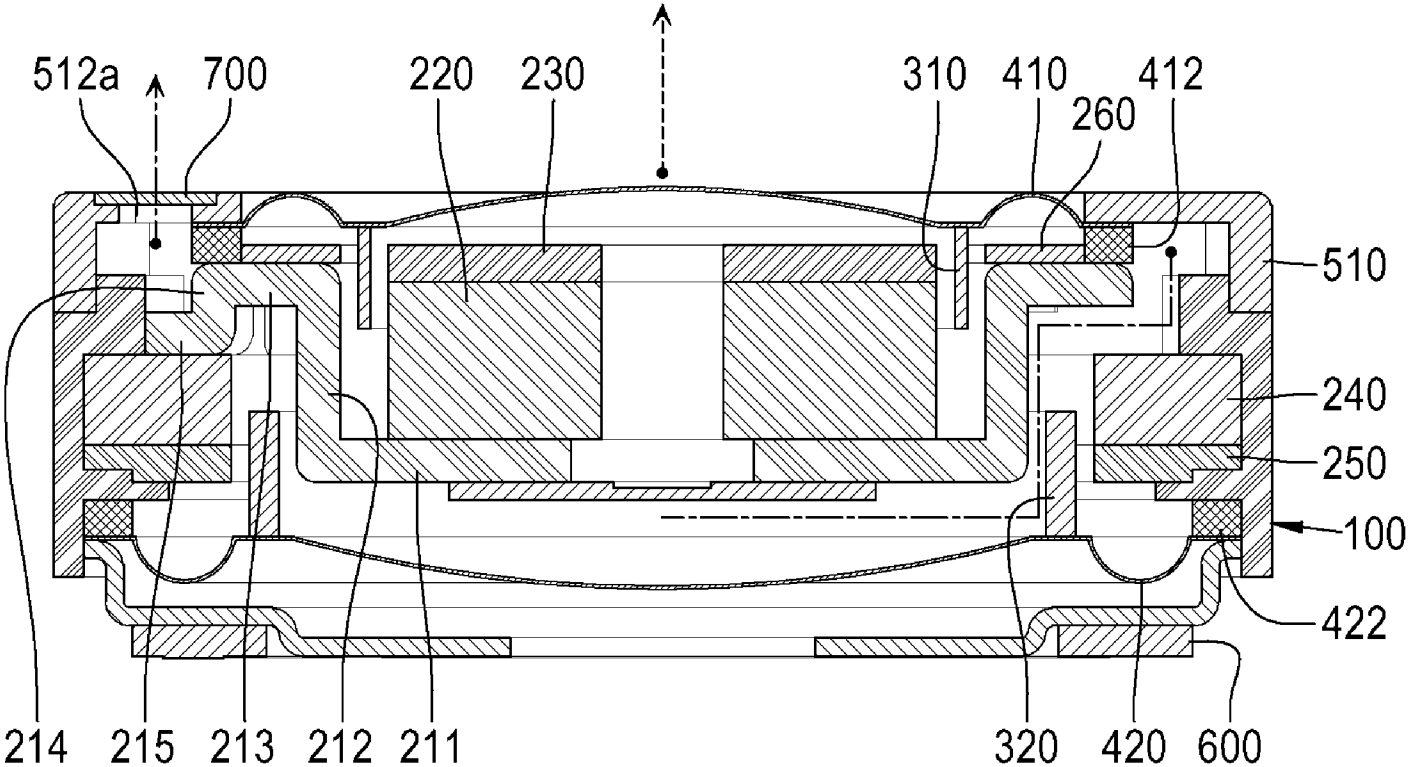
FIG. 2 is a cross-sectional view of a two-way speaker having a bass duct according to an embodiment of the present disclosure.
Figure 3:
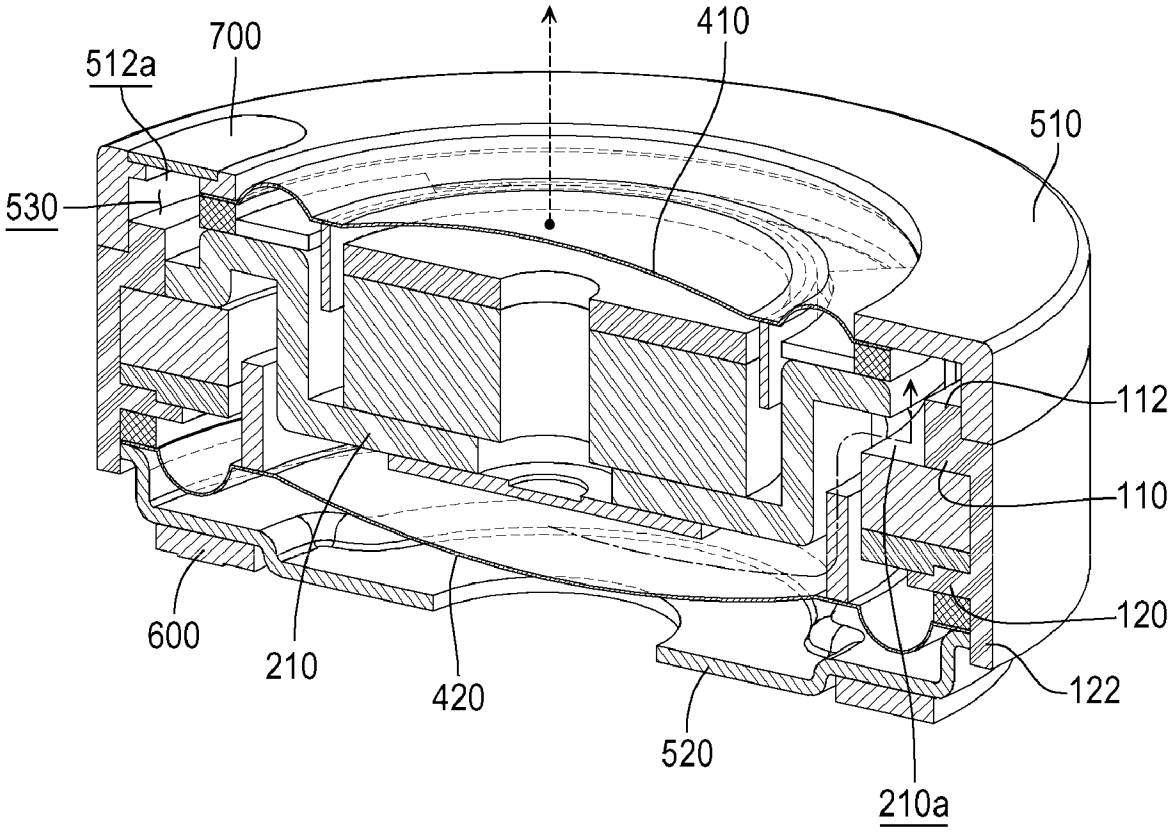
FIG. 3 is a cross-sectional perspective view of a two-way speaker having a bass duct according to an embodiment of the present disclosure.
Figure 4:
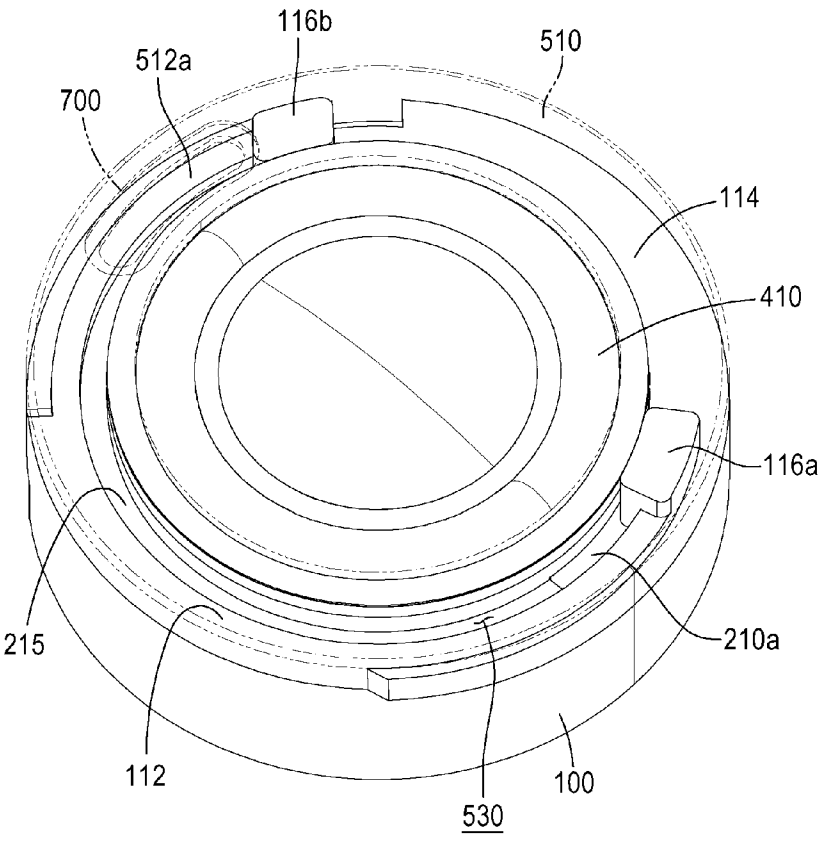
FIG. 4 is a perspective view of a two-way speaker having a bass duct according to an embodiment of the present disclosure.

FIG. 2 is a cross-sectional view of a two-way speaker having a bass duct according to an embodiment of the present disclosure, FIG. 3 is a cross-sectional perspective view of a two-way speaker having a bass duct according to an embodiment of the present disclosure, and FIG. 4 is a perspective view of a two-way speaker having a bass duct according to an embodiment of the present disclosure.

In a two-way speaker having a bass duct according to an embodiment of the present disclosure, a magnetic circuit and a vibrating unit are installed in a cylindrical frame 100. The frame 100 is provided with a yoke 210 dividing an inner space of the frame 100 up and down. With the yoke 210 as a boundary, a first speaker unit is installed at an upper portion of the yoke 210, and a second speaker unit is installed at a lower portion of the yoke 210. The yoke 210 includes cylindrical portions 211 and 212, a first flange portion 213 formed on the outer periphery of the cylindrical portions 211 and 212, the connection wall 214 bent downward from the first flange portion 213, a second flange portion 215 formed on the outer periphery of the connection wall 214, and a communication hole 210*a* formed by removing a portion of the connection wall 214 and a portion of the second flange portion 215.

A first speaker unit is installed at the upper portion of the yoke 210, and the first speaker unit includes a first permanent magnet 220, a first top plate 230, a first voice coil 310, and a first diaphragm 410. The cylindrical portions 211 and 212 of the yoke 210 include a circular bottom surface 211 and a sidewall 212 formed on the outer periphery of the bottom surface 211. The first permanent magnet 220, the outer periphery of the first top plate 230, and the inner surface of the sidewall 212 are formed to be spaced apart from each other, and this space is a first magnetic gap.

A lower end of the first voice coil 310 is positioned in the magnetic gap. An upper end of the first voice coil 310 is attached to the first diaphragm 410, and the first diaphragm 410 vibrates by vibration of the first voice coil 310 to generate sound. The first diaphragm 410 is attached to the first flange portion 213. In this case, a guide ring 412 may be attached to an edge of the first diaphragm 410 to facilitate installation of the first diaphragm 410.

Since the first diaphragm 410 is thin and difficult to handle, installation of the first diaphragm 410 may be facilitated by attaching the guide ring 412 formed of an injection molded product or metal, which is thick and has greater rigidity than the first diaphragm 410. In this case, a ceramic plate 260 may be additionally attached to the first flange portion 213. The ceramic plate 260 is a magnetic structure for compensating for magnetic flux leakage occurring in a bent portion between the sidewall 212 and the first flange portion 213. The ceramic plate 260 is attached to the inside on the first flange portion 213, and the guide ring 412 may be positioned on the outside of the ceramic plate 260 so that the ceramic plate 260 may also serve as a guide an installation position of the first diaphragm 410.

Meanwhile, the second speaker unit is installed at the lower portion of the yoke 210. The second speaker unit includes a second permanent magnet 240 positioned on a lower surface of the second flange portion 215 of the yoke 210 and a second top plate 250 attached to a lower surface of the second permanent magnet 240. In this case, the second permanent magnet 240 and the second top plate 250 may be insert-injected during injection-molding of the frame 100.

The frame 100 includes an upper sheet 110 covering an upper surface of the second permanent magnet 240 and a lower sheet 120 covering a lower surface of the second top plate. In this case, the second permanent magnet 240 and the second top plate 250 have a ring shape, and an inner periphery thereof is installed to be spaced apart from the sidewall 212 of the yoke 210, and this space is a second magnetic gap. An upper end of a second voice coil 320 is positioned in the second magnetic gap, and a lower end of the second voice coil 320 is attached to the second diaphragm 420. An outer periphery of the second diaphragm 420 is seated on the lower sheet 120 of the frame 100. A guide ring 422 may be attached to the edge of the second diaphragm 420 to facilitate installation of the second diaphragm 420. In this case, a lower wall 122 protruding downward may be provided around the lower sheet 120. The guide ring 422 is guided to an inner circumferential surface of the lower wall 122 to match concentricity of the second diaphragm 420.

In addition, a protector 520 for protecting the second speaker unit may be installed below the second speaker unit. The protector 520 is located on a lower surface of the second guide ring 422 and the second diaphragm 420, and an outer circumferential surface of the protector 520 contacts an inner circumferential surface of the lower wall 122 to guide an installation position.

As described above, the yoke 210 has the communication hole 210*a* formed by removing portions of the connection wall 214 and the second flange portion 215. Sound generated by the second speaker unit is emitted upward through the communication hole 210*a*.

Here, the two-way speaker may include a bass duct 530 that bypasses and emits a sound of the second speaker emitted through the communication hole 210*a*. While the sound of the second speaker unit is passing through the bass duct 530, a sound of the middle and high frequency range having strong straightness may be blocked and only a sound of a low frequency range may be emitted.

As described above, the frame 100 includes an upper sheet 110 covering an upper surface of the second permanent magnet 240, and a front cover 510 is attached to the upper sheet 110. The front cover 510 covers the communication hole 210*a* to prevent the sound of the second speaker emitted through the communication hole 210*a* from going straight. A sound emission hole 512*a* is formed at the front cover 510 at a predetermined distance from the communication hole 210*a*. A mesh 700 is attached to the sound emission hole 512*a* to prevent foreign substances from being introduced into the bass duct 530 from the outside, while additionally tuning acoustic characteristics.

The front cover 510 has a cross-section in an L-shape and includes a ring-shaped upper surface and a sidewall bent along the edge of an upper surface thereof. The sidewall is seated on the upper sheet 110 of the frame 100, and an inner periphery of the upper surface is located on the first diaphragm 410.

In this case, the frame 100 includes an upper wall 112 protruding upward at a distance from the edge on the upper sheet 110. The sidewall of the front cover 510 is in contact with an outer circumferential surface of the upper wall 112, and an installation position of the front cover 510 is guided. Meanwhile, the upper sheet 110 of the frame 100 covers the second flange portion 215 of the yoke 210 in a region in which the bass duct 530 is not formed, surrounds the sidewall 214, and is in contact with the outer periphery of the first flange portion 213. Accordingly, the frame 100 may maintain coupling with the yoke 210. Accordingly, the yoke 210, the second permanent magnet 240, and the second top plate 250 may be inserted and injection-molded during injection molding of the frame 100.

In addition, in a region in which the bass duct 530 is formed, an injection-molded material covering the second flange portion 215 may be removed to secure a space used as the bass duct 530. Accordingly, in the region in which the bass duct 530 is formed, an outer circumferential surface of the second flange portion 215 and an inner circumferential surface of the upper sheet 110 of the frame 100 are in contact with each other.

Meanwhile, at both ends of the bass duct 530, a protrusion 116*a* is formed at the upper sheet 110 of the frame 100 to contact the front cover 510, thereby limiting a length of the bass duct 530. The length of the bass duct 530 varies depending on a length of an arc formed by the communication hole 210*a* of the yoke 210 and the sound emission hole 512*a* of the front cover 510, and acoustic characteristics of the two-way speaker may be tuned by changing the length of the bass duct 530.

In general, in the two-way speaker, a woofer speaker in charge of bass is used as the second speaker, and a tweeter speaker or a full-range speaker is used as the first speaker. Here, as the sound generated from the second speaker passes through the bass duct 530, the high and mid-range frequencies are removed and only a low frequency sound is mainly emitted.

The bass duct 530 has the same inner area and length of the duct. A shape of the bass duct 530 is not limited to an arc-shaped structure, but since the size of the first speaker has a smaller cross-sectional area than that of the second speaker, arrangement of the duct on the outer periphery of the first speaker may advantageously reduce the size of the two-way speaker.

Figure 5:
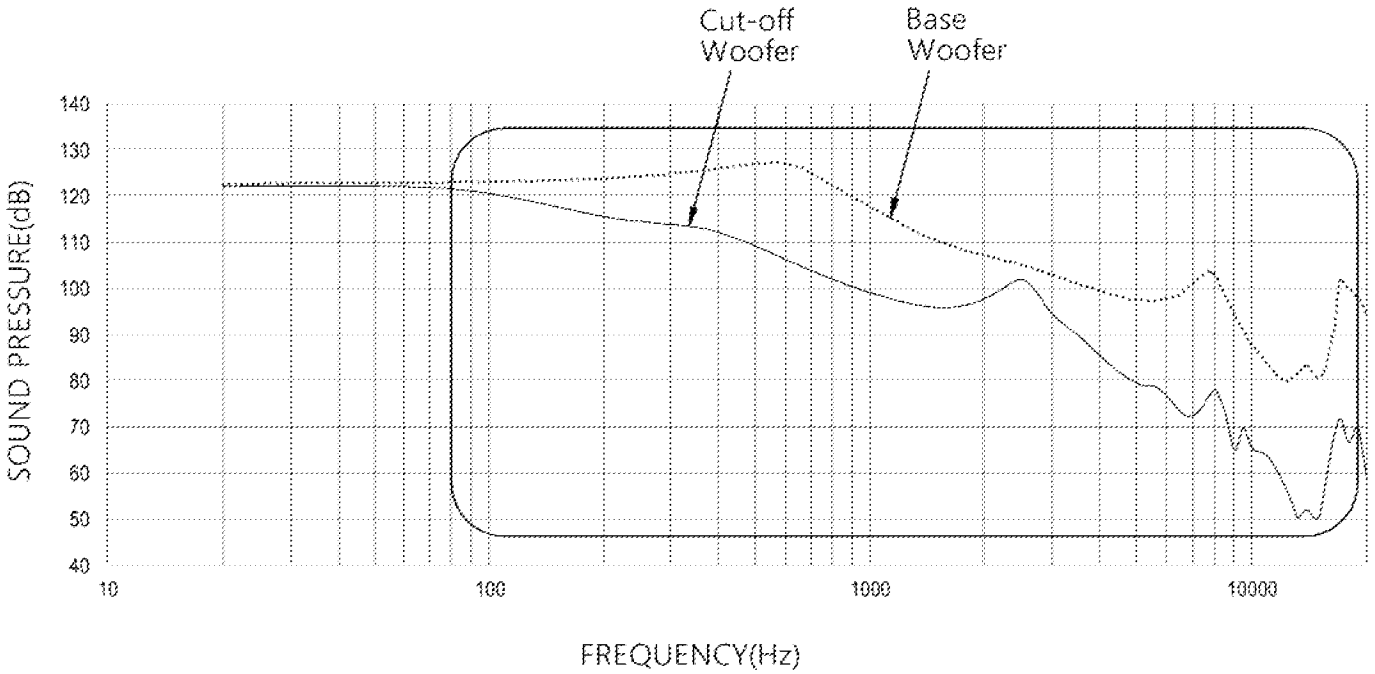
FIG. 5 is a graph showing comparison in sound pressure according to frequencies of a second speaker provided in a two-way speaker according to the related art and a second speaker provided in the two-way speaker according to an embodiment of the present disclosure.

FIG. 5 is a graph showing comparison in sound pressure according to frequencies of a second speaker provided in a two-way speaker according to the related art and a second speaker provided in the two-way speaker according to an embodiment of the present disclosure.

The dotted line indicates sound pressure according to frequencies emitted by the second speaker of the two-way speaker of the related art. The solid line indicates sound pressure according to frequencies emitted by the second speaker of the two-way speaker having the bass duct of the present disclosure. Comparing the two graphs, it can be seen that, in the case of the present disclosure including the bass duct, the sound pressure emitted by the second speaker (woofer speaker) decreases at a mid-range frequency of 100 Hz or higher. That is, it can be seen that the second speaker provided in the two-way speaker of the present disclosure mainly emits low-frequency sound.

Figure 6:
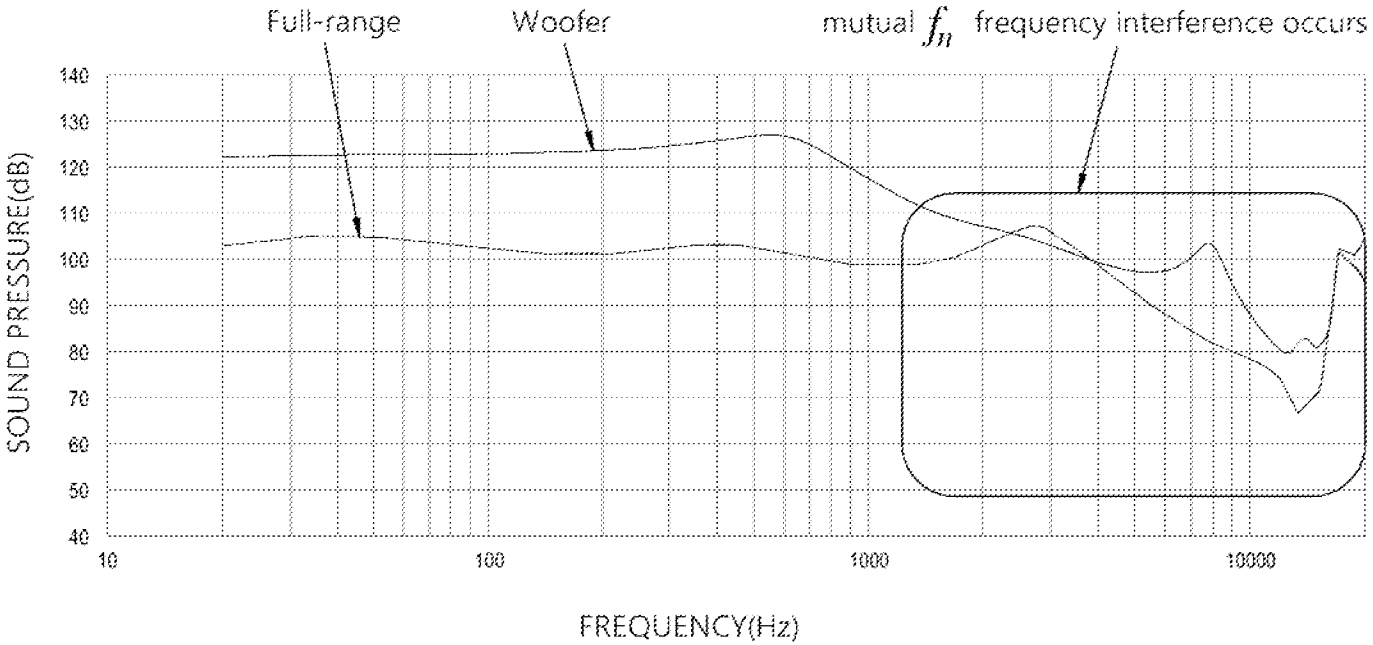
FIG. 6 is a graph showing comparison in sound pressure according to frequencies of a first speaker and a second speaker of a two-way speaker having a bass duct according to the related art.

FIG. 6 is a graph showing comparison in sound pressure according to frequencies of a first speaker and a second speaker of a two-way speaker having a bass duct according to the related art. The alternated long and short dash line represents the first speaker, which is a full-range speaker, and the solid line represents the second speaker, which is a woofer speaker. Referring to the graph, it can be seen that frequency interference occurs between the full-range speaker and the woofer speaker in a high frequency range.

Figure 7:
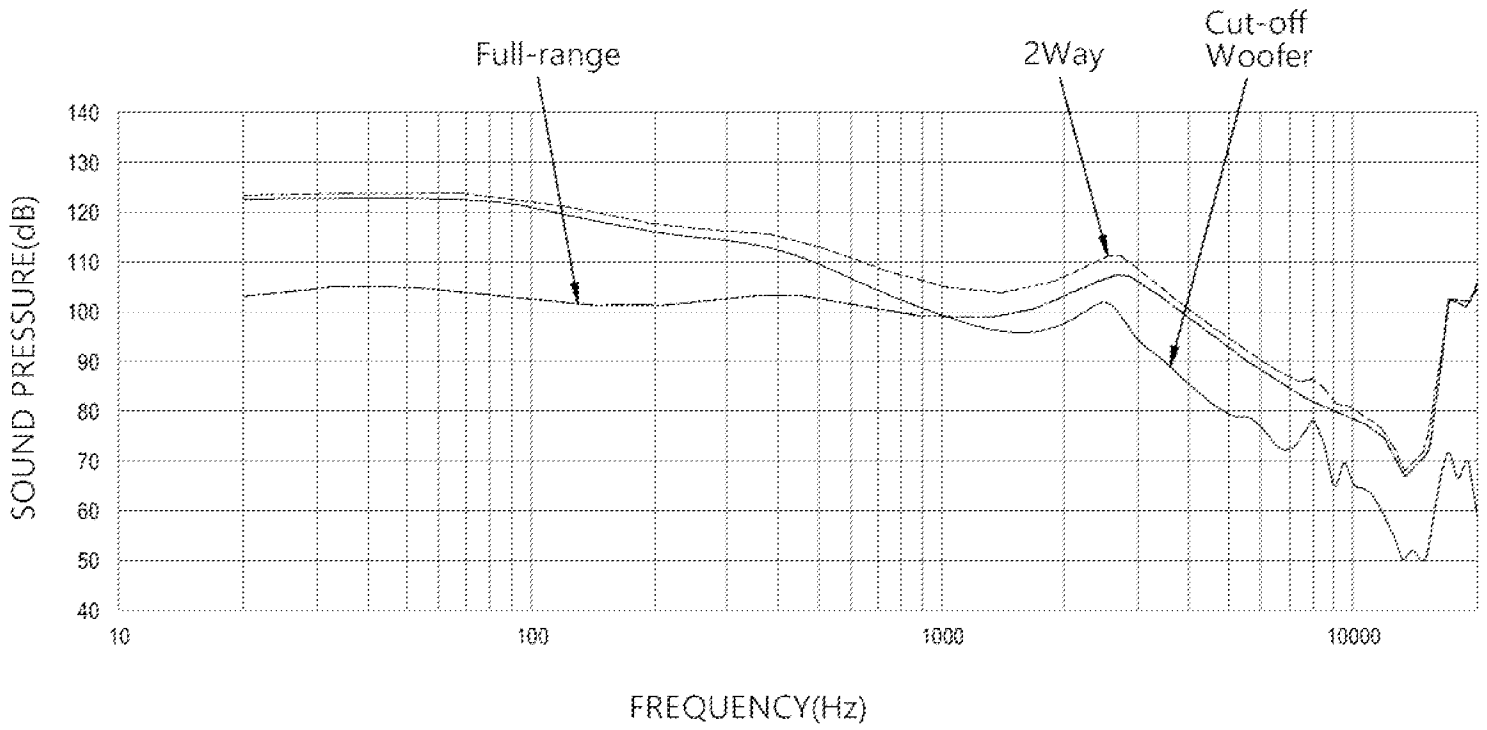
FIG. 7 is a graph showing comparison in sound pressure according to frequencies of a first speaker, a second speaker, and the entire speakers of a two-way speaker having a bass duct according to the present disclosure.

FIG. 7 is a graph showing comparison in sound pressure according to frequencies of a first speaker, a second speaker, and entire speakers of a two-way speaker having a bass duct according to the present disclosure. In the graph, the alternated long and short dash line represents sound pressure for each frequency of the full-range speaker, which is the first speaker, the solid line represents sound pressure for each frequency of the woofer speaker, which is the second speaker, and the dashed line represents sound pressure for each frequency of the overall two-way speaker including the first speaker and the second speaker. Referring to the graph, there is no sound interference between the full-range speaker and the woofer speaker in the high-frequency region of 1000 Hz or higher.

Meanwhile, the sound pressure of the overall two-way speaker may be obtained from the following equation. The SPL (dB) for each frequency of n sound sources is as follows:

$$\text{Total } SPL[\text{dB}] = 20\log\left(10^{\frac{w}{20}} + 10^{\frac{f}{20}} + \ldots\right)$$

Compared to the full-range speaker, the low-frequency sound pressure of the woofer speaker is amplified, so the characteristics suitable for the application of ANC technology may be implemented in the two-way speaker.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A two-way receiver comprising:

a cylindrical frame having a space for accommodating a component;

a yoke dividing an internal space of the cylindrical frame up and down and including a cylindrical portion, a first flange portion formed at an outer periphery of the cylindrical portion, a connection wall bent downward from the first flange portion, a second flange portion formed at an outer periphery of the connection wall, and a communication hole formed by deleting a portion of the connection wall and a portion of the second flange portion;

a first speaker unit installed above the yoke and including a first permanent magnet, a first plate, a first voice coil, and a first diaphragm;

a second speaker unit installed below the yoke and including a second permanent magnet, a second plate, a second voice coil, and a second diaphragm;

a protector coupled to a lower portion of the cylindrical frame and protecting the second speaker unit; and a bass duct formed on an outer periphery of the first speaker unit and having a sound emission hole for emitting a sound of a first frequency range of the second speaker unit emitted to the communication hole of the yoke to a position spaced apart from the communication hole, with bypassing a sound of a second frequency range of the second speaker unit along the bass duct.

2. The two-way receiver of claim 1, further comprising:

an annular front cover having an outer periphery seated on the cylindrical frame and an inner periphery seated on an outer periphery of the first diaphragm, wherein the bass duct is defined by the cylindrical frame, the second flange portion of the yoke, and the front cover.

3. The two-way receiver of claim 2, wherein the first diaphragm is seated on the first flange portion, and wherein the front cover is attached to an upper surface of the first diaphragm.

4. The two-way receiver of claim 2, wherein the cylindrical frame covers an upper surface of the second flange portion and is in contact with an outer periphery of the first flange portion, and wherein a space for the bass duct is secured by deleting a portion of the cylindrical frame covering the upper surface of the second flange portion.

5. The two-way receiver of claim 2, wherein the sound emission hole is formed at the front cover.

6. The two-way receiver of claim 5, wherein sound of the first speaker unit is emitted upward through a central perforation portion of the annular front cover, and wherein the sound of the first and second frequency ranges of the second speaker unit is emitted upward through the sound emission hole formed at the front cover through the communication hole of the yoke and the bass duct.

* * * * *